United States Patent [19]

McGinn

[11] Patent Number: 4,791,872

[45] Date of Patent: Dec. 20, 1988

[54] VEHICLE AND TRACK SYSTEM

[75] Inventor: Terrance E. McGinn, Sellersville, Pa.

[73] Assignee: PSi, Telford, Pa.

[21] Appl. No.: 31,352

[22] Filed: Mar. 30, 1987

[51] Int. Cl.[4] ..... B61B 13/12

[52] U.S. Cl. ..... 104/166; 104/247

[58] Field of Search ..... 104/246, 247, 166, 165, 104/254

[56] References Cited

U.S. PATENT DOCUMENTS

| | | | |
|---|---|---|---|
| 1,252,998 | 1/1918 | Castanho | 104/246 |
| 3,842,752 | 10/1974 | Harwick | 104/166 |
| 3,897,735 | 8/1975 | Watts | 104/166 |
| 4,007,693 | 2/1977 | Desourdy | 104/246 |
| 4,353,306 | 10/1982 | Rohrbach et al. | 104/166 |
| 4,363,275 | 12/1982 | Kaji | 104/166 |
| 4,375,195 | 3/1983 | Tsuboi | 104/246 |
| 4,648,325 | 3/1987 | Gutekunst et al. | 104/166 |

*Primary Examiner*—Sherman D. Basinger
*Assistant Examiner*—Edwin L. Swinehart
*Attorney, Agent, or Firm*—Joseph W. Molasky & Assocs.

[57] ABSTRACT

A vehicle for use in a track system of the type having a rotating drive shaft extending along and parallel to an elongated track has a drive wheel mounted to extend from the side of the vehicle for driving contact with the rotating drive shaft. The vehicle has a speed control means actuated by control members extending from both the front and the rear of the vehicle.

15 Claims, 5 Drawing Sheets

52
64
20
18
54
55
66
150
70
50
130
35
23
96
78
76
24
86
71
94
72
98
82
94
92
88
100
99
101
90
36
11
81
16
80
75
157
155
77
83
132
74
87
22
151
21

FIG. 5
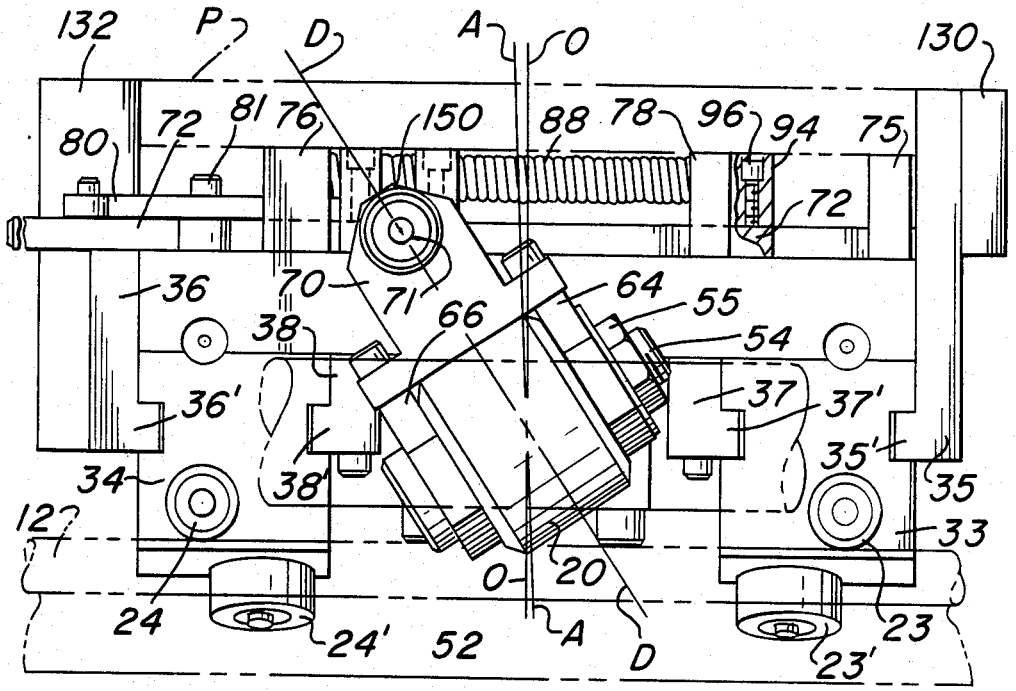
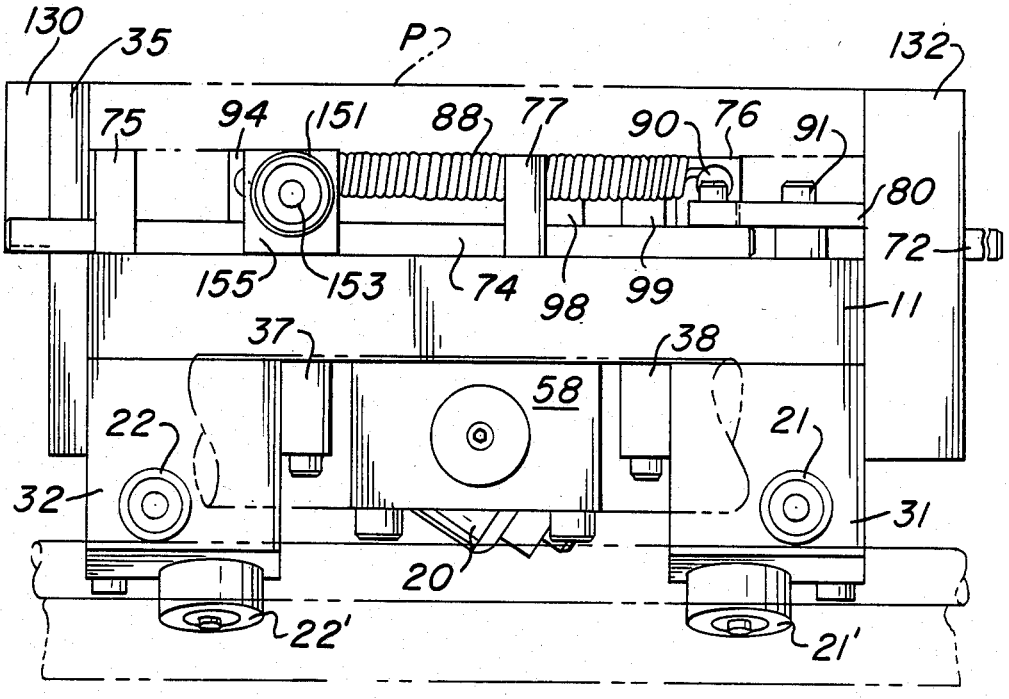
FIG. 6

VEHICLE AND TRACK SYSTEM

BACKGROUND OF THE INVENTION

1. Field of the Invention

This invention relates to the field of vehicle and track systems of the type wherein the vehicle is supported on an elongated track and has a drive wheel for cooperation with a rotating drive shaft extending along and parallel to the track. Systems of the indicated type are particularly useful for moving work pallets from station to station as various assembly, machining, processing or test operations are performed on articles supported thereon. Moreover, systems of the indicated type are capable of operating with a non-synchronous transfer load (i.e., the vehicles can move independently of each other), and with a track system that comprises angle turns or elevators to transport the articles.

2. Description of the Prior Art

There have been provided vehicle and track systems in the prior art of the type disclosed herein which are particularly suitable for high speed movement of articles from one precise position to another. In this type of system, in order to operate at relatively high speed during transport, a speed control means for cooperation with the vehicle drive wheel must be utilized. Also, the drive shaft must be mounted for rotation parallel to the movement of the vehicle and the vehicle must be retained on the track in a manner to prevent the vehicle from disengaging from the track at high rates of speed. Also, these systems must be designed to permit vehicles to approach and contact a vehicle in front thereof and there must be provided a control device to cooperate with the drive wheel to effect dense accumulation of vehicles along the track system.

U.S. Pat. Nos. 423,872 issued to Judson and 4,036,148 issued to Jones et al exemplify prior art vehicle track systems having a drive wheel, a drive shaft and a track connected in cooperation therewith to provide forward travel of a vehicle therealong. U.S. Pat. No. 3,818,837 issued to Jacoby et al exemplifies prior art vehicle and track systems which are provided with a speed control means on their front ends for cooperation with a cam on the rear end of the next vehicle on the track system to effect dense accumulation of vehicles along the system.

A problem encountered with vehicle and track systems of the prior art is the location of the shaft directly beneath the vehicle whereby there is interference with any process to be performed from below the vehicle.

Another problem encountered with the prior art systems is that the vehicle is either not self-supporting independently on the drive shaft whereby the drive wheel is affected by either light or heavy loads because of the force applied from the drive wheel to the drive shaft.

Another problem of the prior art systems wherein the vehicle is spring-loaded to the drive shaft directly beneath it is that while the vehicle is restrained on the track, it cannot be removed from the track without disassembling a track section.

Another problem with the prior art systems wherein a speed control device is located at the front end for cooperation with the rear end of the next vehicle to achieve dense accumulation, is that the vehicle cannot be run in the reverse direction and still maintain a speed control means in cooperation with the vehicle in that backwards direction.

Another problem with the prior art systems is that they employ mechanisms to effect dense accumulation of vehicles along the system which do not maintain a precise distance between the accumulated vehicles and in the accumulation position they maintain the angular position of the drive wheel at 0° when cooperating with the next vehicle on the track system thereby resulting in "hunting" or oscillating of the vehicle.

SUMMARY OF THE INVENTION

It is the general object of this invention to provide a novel vehicle and track system of the type having an elongated track and a rotating drive shaft extending along ad parallel to the track.

Another object of the invention is to provide a vehicle which is self-supporting so as to be independent of the drive shaft and whose drive wheel is constructed and arranged so as to not be affected by the size of the load on the vehicle.

Another object of the invention is to provide a drive wheel means which extends from the side of the vehicle to cooperate with the drive shaft thereby allowing access to the vehicle from below and providing a driving engagement between the drive wheel and the drive shaft which is independent of the weight of the vehicle.

It is another object of the invention to provide a vehicle whose support wheel assembly is constructed and arranged to be spring-loaded so that while it can be restrained on the track during movement therealong it can also be removed from the track at any time.

It is another object of the invention to provide a speed control means on the vehicle for controlling movement thereof in either the forward or rearward direction and for causing the stopping of the vehicle as it moves in the forward or rearward direction. Providing the two direction speed control in combination with the arrangement whereby the vehicle can be removed from the track allows the vehicle to be transferred to another track which is parallel to the first track in any attitude and runs in the rearward direction.

Another object of the invention is to provide a novel vehicle which has a speed control means which positions the drive wheel in the accumulation position thereof in an angular relation to the drive shaft of other than 0° thereby leaving a small forward velocity on the vehicle. This prevents hunting or oscillating of the vehicle and maintains a stationary condition of the vehicle.

Another object of the invention is to provide a precision gage block on both the front and rear ends of the vehicle so that a precise distance is maintained between the accumulated vehicles in the accumulation position thereof by use of the speed control means.

Briefly stated, the general objects of the invention are achieved by a construction comprising a vehicle body, support wheel means on the bottom side of the vehicle body constructed and arranged to ride on the track and support the vehicle thereon, a drive wheel means including a drive wheel mounted on the side of the vehicle body and extending therefrom into driving contact with the rotating drive shaft, and means mounting the drive wheel for movement about a horizontal axis between a drive position in which the vehicle is driven along the track at a high speed and an accumulation position in which the vehicle is maintained in a stopped position in contact with another vehicle on the track, and vehicle speed control means including means for actuating the drive wheel between the drive and accumulation positions thereof. Further, the drive wheel actuating means comprises a first control member projecting forwardly from the front end of the vehicle body when the drive wheel is in its drive position, a second control member projecting rearwardly from the rear end of the vehicle when the drive wheel is in its drive position and an actuating member operatively connected to the first and second control members and to the drive wheel and movable in response to the inward movement of either of said control members for actuating the drive wheel between the drive position and the accumulation position.

BRIEF DESCRIPTION OF THE DRAWINGS

FIG. 5 is a sectional view taken along line 5—5 of FIG. 4.

FIG. 6 is a sectional view taken on line 6—6 of FIG. 4.

DETAILED DESCRIPTION OF THE PREFERRED EMBODIMENT

Figure 1:
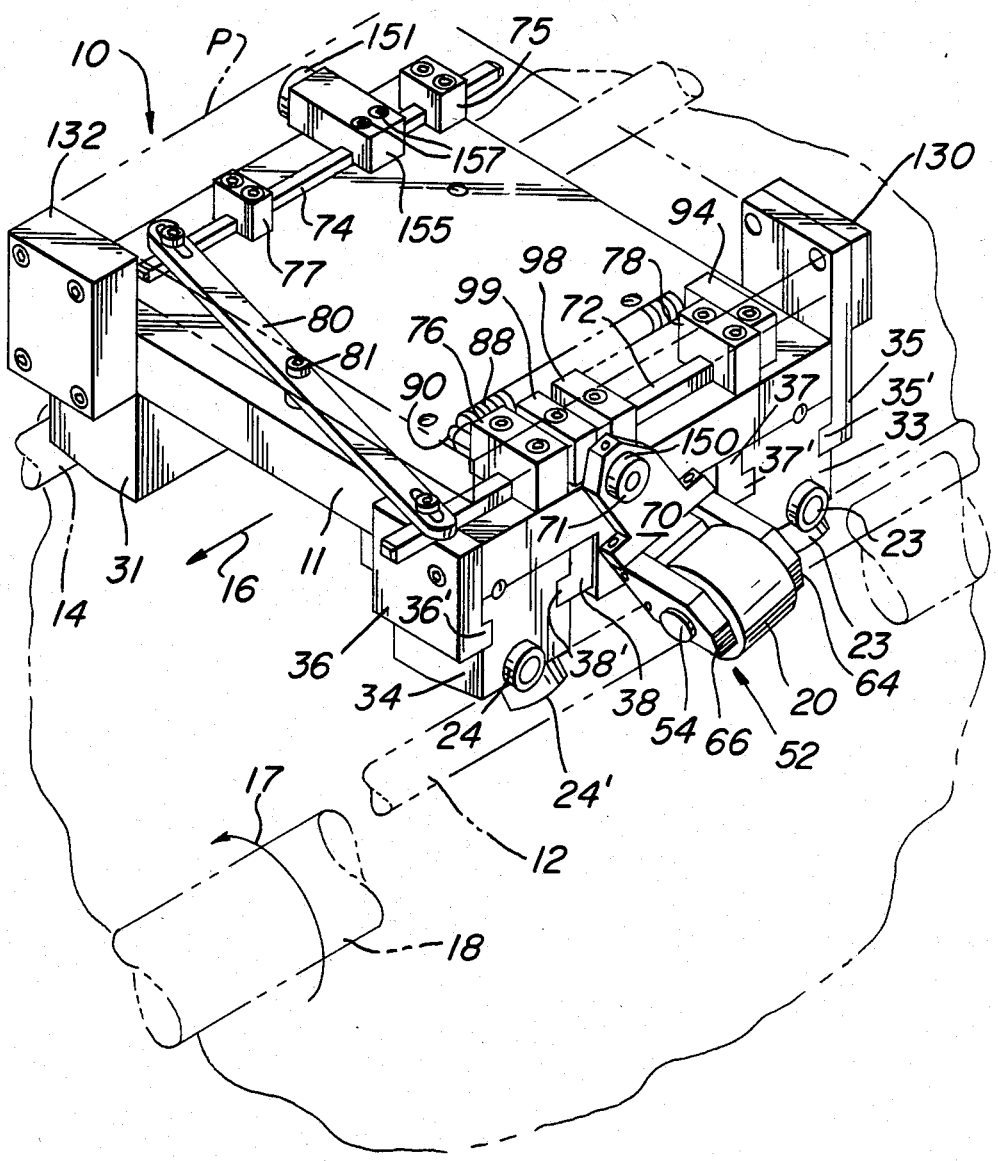
FIG. 1 is a perspective view of a vehicle and track system in accordance with the present invention.

Referring to the Drawings in detail, there is shown in FIG. 1 a vehicle generally indicated at 10 adapted to ride along tracks 12 and 14 of the system. Tracks 12 and 14 are circular in cross-section and are mounted on a floor or other supporting means by supports 13 and 15, respectively. In FIG. 1, the vehicle 10 is driven in the direction indicated by the arrow 16 by means of a drive shaft 18 which is driven to rotate about its longitudinal axis (in the direction of arrow 17) by a suitable motor driven drive means (not shown). The drive shaft 18 extends in spaced apart parallel relation to the tracks 12 and 14 and is comprised of a plurality of axially aligned interconnected rods supported for rotation by a plurality of suitable bearing means 19 (FIG. 4) spaced along the length thereof as is well known in the art.

The rotary movement of the drive shaft 18 is converted into longitudinal movement of the vehicle 10 by the interaction between the drive shaft 18 with a drive wheel means mounted to extend from the side of the vehicle body 11. The drive wheel means comprises a drive wheel 20 biased into driving contact with the surface of rotatnng drive shaft 18. The principles of this interaction between drive shaft 18 and rotating drive wheel 20 to cause movement of the vehicle 10 arewwell known in the art and are described in said prior-mentioned patents. Briefly, when the drive wheel 20 is positioned in an angular relation to the drive shaft 18 as shown in FIG. 1, the rotation of the drive shaft 18 produces a longitudinal force on drive wheel 20, which force is transmitted through drive wheel 20 to the vehicle 10, and the drive wheel 20 will follow a helical path of contact along the drive shaft118, i.e., as the vehicle 10 is driven along the tracks 12 and 14. As is well known in the art and as is described in said prior mentioned patents, the vehicle 10 can have its speed increased or decreased by changing the rolling angle of drive wheel 20 along the drive shaft 18. A greater rolling angle produces a greater speed of the vehicle 10. In a manner to be described more fully hereafter, the drive wheel means is mounted for movement in response to actuation by a speed control means to change the rolling angle. In the drawings, the parts are shown in the drive position wherein the rolling angle is 35°, which produces the maximum speed of vehicle 10 along tracks 12 and 14. It is to be noted that if the drive wheel means were movd to the position wherein the axis of rotation of drive wheel 20 is parallel to the longitudinal axis of drive shaft 18 (this is the 0° position when the rolling angle is at a right angle to the longitudinal axis of drive shaft 18), there is no movement of the vehicle 10 along tracks 12 and 14.

Vehicle body 11 has a rectangular configuration for supporting a rectangular platform P whose outline is shown in dashed lines in FIG. 1. Support wheel means providing independent support for vehicle 10 are provided on the bottom of the vehicle body 11 and are constructed and arranged to ride on the tracks 12 and 14 in the manner to be described more fully hereafter. Also, as discussed above, the drive wheel means is mounted to extend from the side ofthe vehicle body 11 with drive wheel 20 spring-biased into driving contact with the rotating drive shaft 18. Also mounted on the vehicle body 11 are means for mounting the drive wheel 20 for movement about a horizontal axis between a "drive" position and a "vehicle accumulation" position. Also mounted on the vehicle body 11 are the vehicle speed control means as will be described more fully hereafter.

Figure 3:
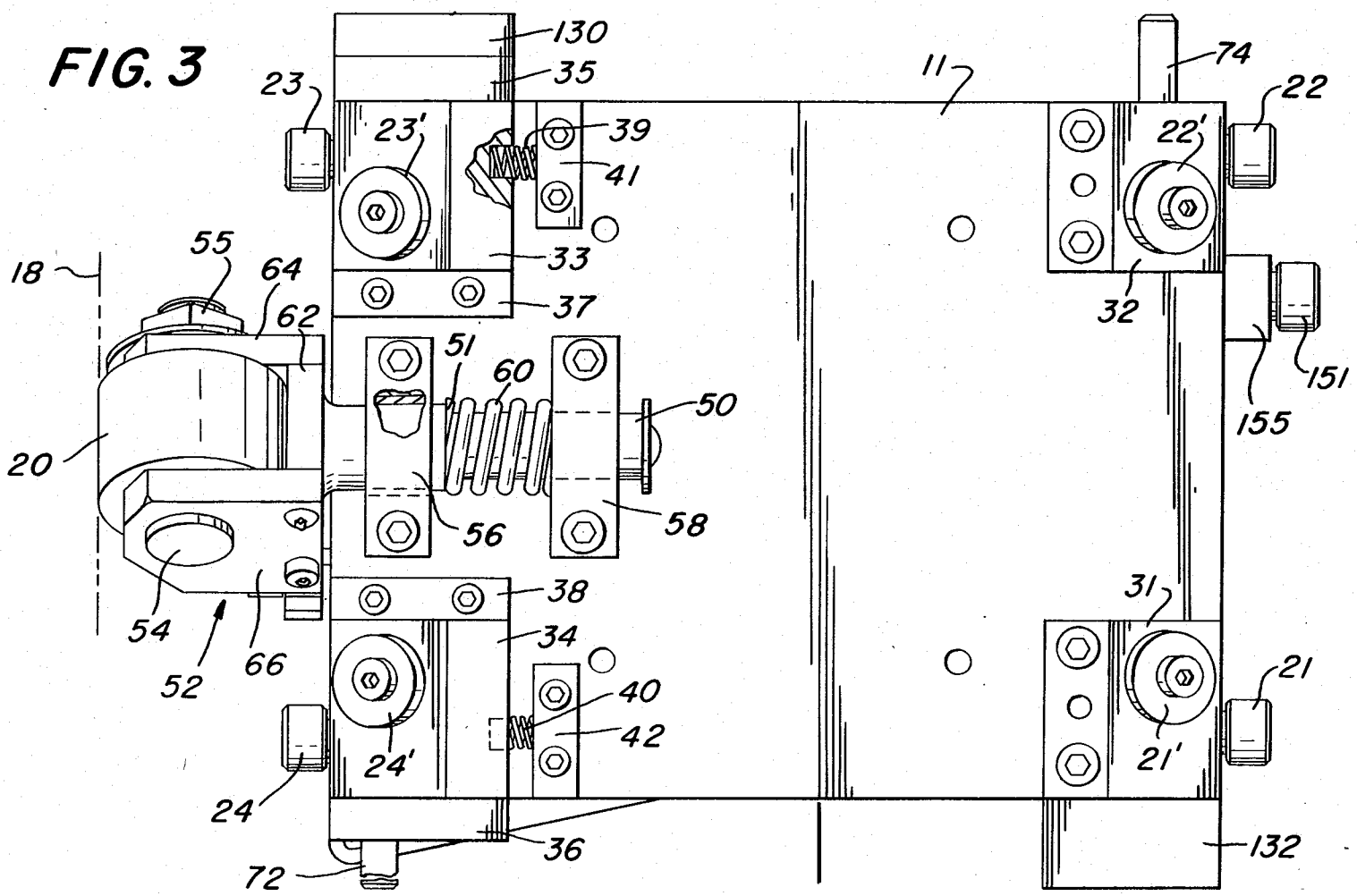
FIG. 3 is a bottom view of the vehicle shown in FIG. 1.
Figure 4:
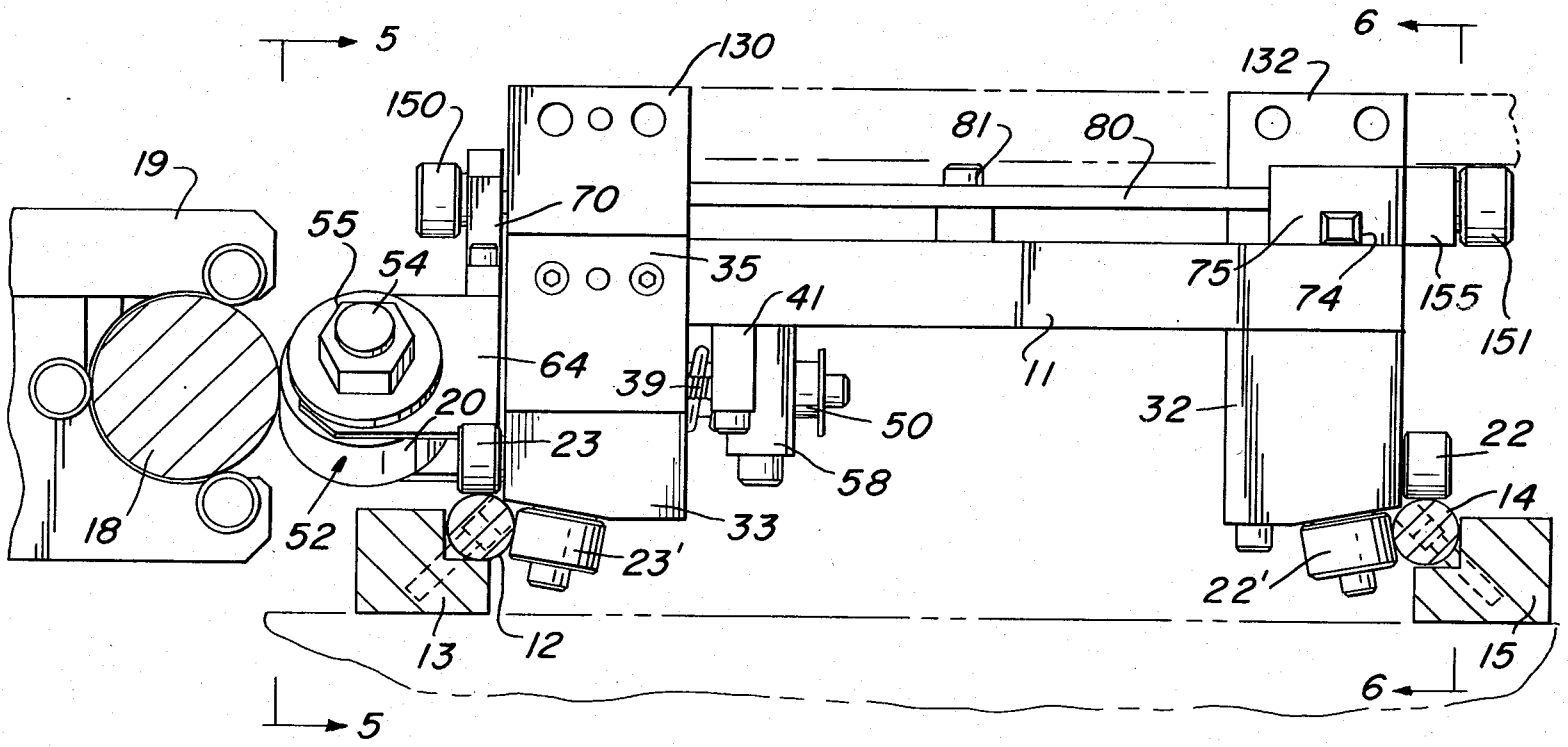
FIG. 4 is a rear end view of FIG. 1.

The support wheel means for vehicle 10 comprises four pairs of cooperating wheels including suppor wheels 21, 22, 23 and 24 mounted to ride on the upper surface of tracks 12 and 14 to support the vehicle thereon and four retaining wheels 21', 22', 23' and 24' mounted to ride on the underside of tracks 12 and 14 (as best shown in FIG. 4) for restraining the vehicle 10 thereon. The cooperating pairs of wheels 21 and 21', 22 and 22', 23 and 23' and 24 and 24' are carried on blocks 31, 32, 33 and 34, respectively, mounted on the underside of body 11 at the corness thereof. Blocks 31 and 32 are fixedly secured to the underside of body 11 by suitable mounting screws as best shown in FIG. 3. Blocks 33 and 34 are mounted for sliding movment laterally of vehicle body 11 toward and away from track 12. To this end, block 33 is supported on a pair of guide supports 35 and 37 fixedly mounted on body 11 by suitable mounting screws and block 34 is slidably supported on a pair of guide supports 36 and 38 fixedly mounted on body 11 by suitable mounting screws as shown in the Drawings. As best shown in FIG. 1, guide supports 35 and 37 provide guides 35' and 37', respectively, which project inwardly toward one another and extend laterally. Guides 35' and 37' are received in cooperating recesses in block 33 for guiding the same for movement toward and away from track 12. In a like manner, guide supports 36 and 38 provide inwardly and laterally extending guides 36' and 38', respectively, received in cooperating recesses in block 34 for guiding the same for movement toward and away from track 12. Blocks 33 and 34 are biased laterally outwardly toward track 12 by means of compression springs 39 and 40, respectively. Spring 39 is mounted in compression between the bottom of a bore in block 33 and a spring retainer 41 secured on the underside of body 11 by suitable mounting screws, and spring 40 is mounted in compression between the bottom of a bore in block 34 and a spring retainer 42 secured on the underside of body 11 by suitable mounting screws.

The manner in which the support wheel means functions to support the vehicle 10 on tracks 12 and 14 and restrain them on these tracks is more clearly shown in FIG. 4 wherein the cooperating pairs of wheels 23 and 23' and 22 and 22' are shown. This figure shows that the support wheels 23 and 22 (as well as support wheels 21 and 24, not shown) are mounted on horizontally extending axles so as to make contact with and ride on the upper surface or edge of tracks 12 and 14, respectively. Retaining wheels 23' and 22' are mounted on axles which extend on an axis making an acute angle with the vertical and make contact with and ride on the tracks 12 and 14 at a location on the circumference thereof below the horizontal plane extending through the longitudinal axis thereof. The location of the contact of the retaining wheels 22 and 23 may be varied somewhat but must be at some location below the horizontal, whereby each cooperating pair of wheels contact the surface of tracks 12 and 14 at locations spaced apart around the track circumference a distance greater than one-fourth the track circumference. While typically the amount of the circumference of the tracks 12 and 14 enclosed by a pair of cooperating wheels is just slightly greater than one-fourth of the track circumference, this could be increased in applications where very high speeds and light vehicles are employed, in which case there is an increased tendency for the vehicle to fly off the tracks. In this case, the enclosed circumference would be increased somewhat.

It is noted hhat by reason of the support wheel means of the invention as described above in conjunction with the construction and araangement of the drive wheel means whereby the drive wheel 20 is biased to cause a horizontal side force thereon against the drive shaft 18, there is provided avvehicle which is self-supporting and independent of the drive shaft 18 so as not to be affected by light or heavy loads. Furthermore,because of the side mounted drive wheel means and the retractable restraining wheel arrangement, the vehicle 10 is removable from tracks 12 and 14 without having to disassemble track sections and can be transferred at any time to another drive shaft which is above or below or perpendicular to the first drive shaft.

The drive wheel means includes drive wheel 20 and means for mounting drive wheel 20 for movement about a horizontal axis between a drive position, in which the vehicle 10 is driven along tracks 12 and 14 at a high speed, and an accumulation position, in which vehicle 10 is maintained in a stopped position in contact with another vehicle on tracks 12 and 14. Such means comprises a pivot shaft 50, a yoke assembly 52 and a drive wheel axle 54. Pivot shaft 50 is supported on the underside of body 11 by means of a pair of bearing assemblies 56 and 58, each of which carries a sleeve bearing for rotatably supporting pivot shaft 50 to extend on a horizontal laterally extending axis. As best shown in FIG. 3, the outboard bearing assembly 56 supports shaft 50 at an enlarged diameter portion thereof while the inboard bearing assembly 58 supports shaft 50 at a reduced diameter portion. A coil spring 60 is mounted in compression between the inboard bearing assembly 58 and a shoulder 51 formed on the inner end of the enlarged diameter portion of shaft 50 to bias shaft, 50 outwardly toward drive shaft 18. The yoke assembly 52 is supported at the extended end of shaft 50 and comprises a base portion 62, which is formed as part of the outer end of the enlarged diameter portion of shaft 50, and a pair of spaced apart yoke members 64 and 66 secured by mounting screws to the outer end of base portion 62 at the outer end of shaft 50 as is best shown in FIG. 3.

The drive wheel axle 54 has an enlarged head at one end and is threaded at its other end and is secured on the yoke members 64 and 66 by a nut 55 cooperating with the threaded end thereof as is best shown in FIG. 5. Drive wheel 20 is supported on the portion of the axle 54 located between the yoke members 64 and 66 and is freely rotatably mounted thereon by means of suitable rolling bearings, rreferably roller bearings. By this arrangement, the drive wheel 20 is mounted for rotation about an axis which can be moved in a vertiaal plane spaced apart and parallel to a vertical plane extending through the longitudinal axis of drive shaft 18. In a like manner, the line of contact between the drive wheel 20 and drive shaft 18 is movable in a similar vertical plane tangent to the circumference of drive shaft 18. Also, the center of rotation of the drive wheel 20 is the horizontal axis of pivot shaft 50. Thus, the rolling angle at which the drive wheel 20 contacts the drive shaft 18 can be changed by rotating pivot shaft 50 and thereby changing the angular position of drive wheel axle 54 (and drive wheel 20 thereon)relative to the drive shaft 18.

As discussedaabove, when the parts are in the position shown in the drawings, the rolling angle is 35°, whereby the rotation of drive shaft 18 produces a longitudinal force on the drive wheel 20 which causes the vehicle 10 to move along the tracks 12 and 14 at a maximum speed, this position having been referred to astthe "drive" position.

In accordance with the invention, vehccle speed control means have been provided, such means including means for actuating the drive wheel 20 between said drive position and said vehicle accumulation position. Such means comprises a control arm 70 mounted on the yoke members 64 and 66 by suitable mounting screws for conjoint movement therewith. The control arm 70 extends generally upwardly along the side of body 11 to a location above the top side thereof. At this upper end the control arm 70 carries an actuating pin 71 which extends horizontally across the top of body 11 for engagement with a speed control actuating means.

Figure 2:
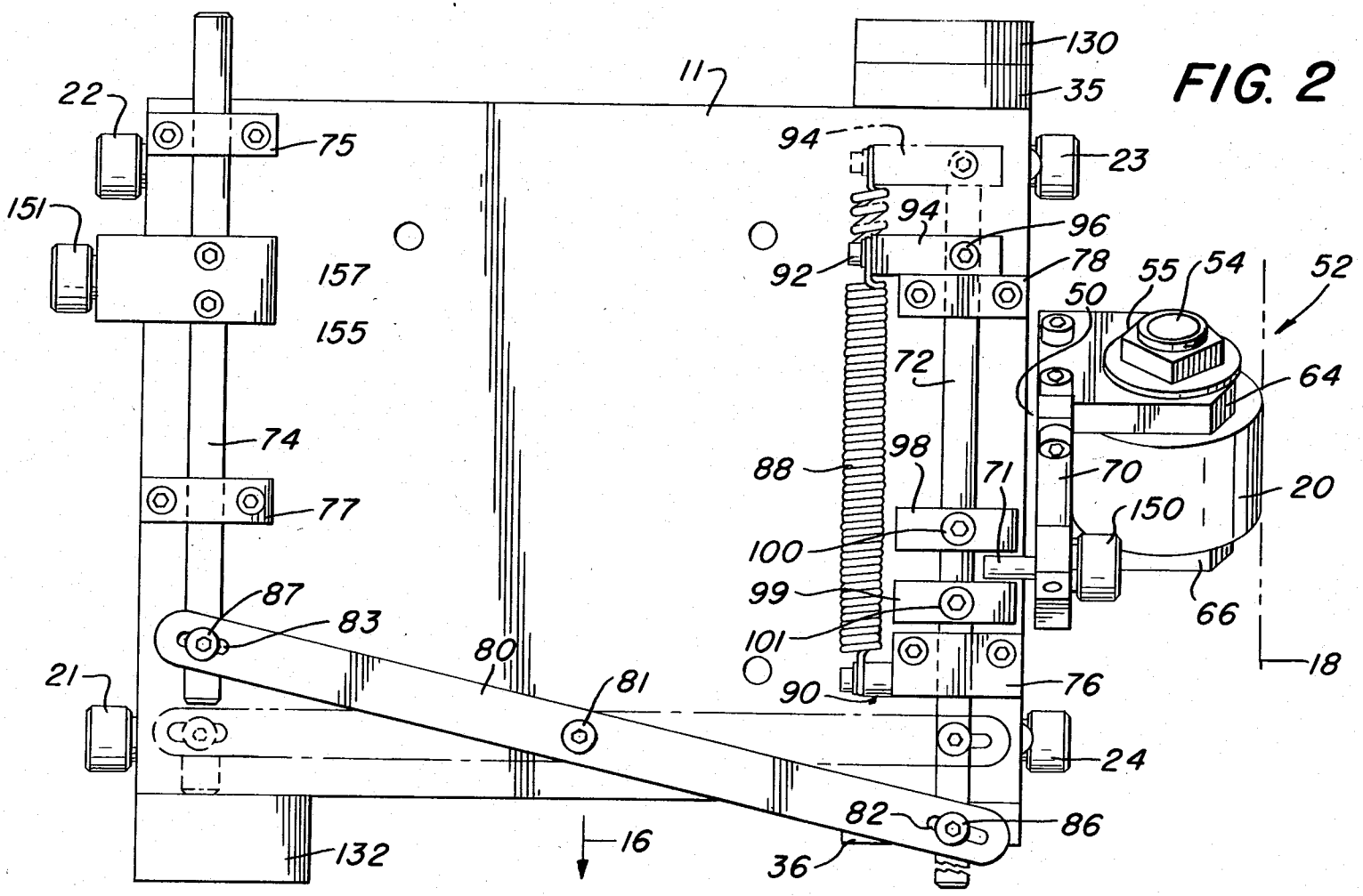
FIG. 2 is a top plan view of the vehicle shown in FIG. 1.

The vehicle speed control means in accordance with the invention comprises means for actuating the drive wheel 20 between a drive position (shown in the Drawings) and a vehicle accumulation position. The drive wheel actuating means includes a first control member in the form of a bumper rod 72 mounted for sliding movement on vehicle body 11 and having a free end projecting from the front end of the vehicle body 11 in the drive position and a second control member intthe form of a bumper rod 74 mounted for sliding movement on the vehicle body 11 and having a free end projecting from the rear end of vehicle body 11 in the drive position. Bumper rod 72 has a square cross-section and is slidably received in square recesses in a pair of spaced apart blocks 76 and 78 each of which ss secured onto the top side of vehicle body 11 by a pair of suitable mounting screws as is shown in FIGS. 1 and 2. In a like manner, bumper rod 74 has a square cross-section and is slidably received in square recesses in a pair of spaced apart blocks 75 and 77 each of which is secured onto the top side of vehicle body 11 by a pair of suitable mounting screws as is shown in FIGS. 1 and 2. By this arrangement, bumper rods 72 and 74 are guided for slidable movement within their associated blocks across the top side of vehicle body 11 along an axis extending parallel to tracks 12 and 14 and along the direction of movement of vehicle 10.

In accordance with the invention, there is provided a linkage means operatively engageable with bumper rods 72 and 74 for causing conjoint movement thereof from an extended position to a retracted position in response to an inward movement of the free ends of either of bumper rods 72 and 74, such as would occur if either of the bumper rods 72 and 74 came into contact with another vehicle on tracks 12 and 14 at a vehicle accumulation position. Such linkage means comprises a iink member 80 pivotally mounted at a central location on a pivot pin 81 mounted on and projecting upwardly from the top side of vehicle body 11. The extended end portions of link member 80 are provided with slots 82 and 83 which are adapted to receive screws 86 and 87, respectively, secured on bumper rods 72 and 74, respectively, at locations inwardly of the free ends thereof. By this arrangement, link member 80 is engaged with bumper rods 72 and 74 and is constructed and arranged to mvve between the solid and dashed line positions shown in FIGS. 1 and 2 in response to the inward movement of either bumper rods 72 and 74 from an extended postion (shown in solid lines) to a retracted position, such as would occur when the vehicle 10 came into contact with a similar vehicle on tracks 12 and 14 at a vehicle accumulation position.

Means are provided for biasing the speed control means to the drive position. Such means comprises a tension spring 88 connected at one end to a pin 90 secured to and extending horizontally from the fixedly mounted block 76 and a pin 92 secured to and extending horizontally from a block 94 mounted on the rearward end of bumper rod 72 by means of a set screw 96 (see FIG. 5). By this arrangement, block 94 and pin 92 move with the rear end of bumper rod 72 away from pin 90 as bumper rod 72 is moved inwardly between the solid and dashed line positions shown in FIG. 2 to stretch the tension spring 88. Spring 88 maintains a bias on block 94 and bumper rod 72 connected thereto to urge the same toward the drive position. Also, since bumper rods 72 and 74 are interconnected by link member 80, all the parts are biased to the drive position. The drive position is set by the position of block 94 on the rear end of bumper rod 72 in conjunction with the stopping action that occurs when block 94 comes into contact with the block 78 which limits the forward movmment of block 78 as is apparent from a consideration of FIGS. 1 and 2.

The speed control means for actuating the drive wheel 20 between the drive and the vehicle accumulation positions is arranged to be responsive to inward movement of either of the bumper ros 72 and 74. To this end, the control arm 70 and the actuating pin 71 are arranged so that the free end of the actuating pin 71 s captured between a pair of blocks 98 and 99 secured on bumper rod 72 by set screws 100 and 101, respectively. By this arrangement, as bumper rod 72 is moved between the drive and vehicle accumulation positions across the top of the vehicle body 11, this movement is transmitted by the control arm 70 and the yoke assembly 52 to drive wheel 20 causing a pivoting moveent of the drive wheel 20 about the hrrizontal axis of the shaft 50. As described above, this movement changes the rolling angle of drive wheel 20 on drive shaft 18.

As is shown in FIG. 5, the drive position is indicated by line D—D which shows the angular position of drive wheel 20 to set a 35° rolling angle between drive wheel 20 and drive shaft 18; the vehicle accumulation position is indicated by line A—A which shows the angular position of drive wheel 20 to set a 2° rolling angle between drive wheel 20 and drive shaft 18; and line 0—0 illustrates the 0° angular position of drive wheel 20, in which drive wheel 20 rotates about an axis parallel to the axis of drive shaft 18 so that (at least theoretically) there is no driving force transmitted therebetween. In accordance with the invention, the vehicle accumulation position is set to produce a small, ie., 2° rolling angle, so that a very small driving force in the forward direction is maintained on the vehicle 10. This overcomes the problem of the vehicle "hunting" or oscillating in the vehicle accumulation position as would occur if the vehicle were set in the 0° position. This is the problem that occurs with the prior art devices which attempt to set the vehicle at a 0° rolling angle in the vehicle accumulation position.

In accordance with the invention, there is provided a precision gage block on both the front and rear end of the vehicle so that a precise distance is maintained between the vehicles in the accumulation position thereof. Such means comprises the precision gage blocks 130 and 132 which are arranged to control the precise location of one vehicle as it stops against a preceding vehicle on the tracks 12 and 14. Gage block 130 is mounted by suitable mounting screws onto block 35 on the rear end of the vehicle body 11 at a location aligned with the bumper rod 72 so that when vehicle 10 is in the vehicle accumulation position, gage block 130 will be contacted initially by the forwardly extending end of a similar bumper rod on another vehicle on tracks 12 and 14 as said other vehicle moves into the vehicle accumulation position, after which the block 36 on said other vehicle comes into contact with gage block 130 to maintain a precise distance between said vehicles. The gage block 132 is secured by suitable mounting screws onto front end of vehicle body 11 and will contact the rear end of the body 11 of a preceding vehicle so as to cooperate with the other gage block 130 to maintain a desired distance between said vehicles. Gage blocks 130 and 132 are made to precise size requirements so as to provide an arrangement whereby a precise distance is maintained between accumulated vehicles when they are in contact with one another along tracks 12 and 14.

There are provided means adapted to be responsive to a vehicle stopping device (not shown) located independently of the vehicle 10 adjacent either of the tracks 12 and 14. Such means comprises a pair of follower rollers 150 and 151. Follower roller 150 is mounted on the outer end of pin 71 that projects from control arm 70 toward drive shaft 18. It will be apparent that follower roller 150 can be contacted as the vehicle 10 moves in the forward direction to cause the same movement of the parts as the inward movement of bumper rod 72. Follower roller 151 is mounted on a pin 153 extending outwardly from a block 155 mounted on bumper rod 74 by a pair of set screws 157 at a location overlying track 14. It wil be apparent that follower roller 151 can be contacted as the vehicle moves in the rearward direction to cause the same movement of the parts as the inward movement of bumperrod 74.

In the operation of the vehicle and track system in accordance with the invention, the parts will be biased to the drive position by the sprnng 88 as discussed above. Thus, with the drive shaft 18 rotating in the direction indicated by the arrow 17, the vehicle 10 will be driven in the forward direction, indicated by the arrow 16, along tracks 12 and 14. When the forwardly moving vehicle reaches a vehicle accumulation position, the front end bumper rod 72 comes into contact with the rear end of a preceding vehicle. More specifically, the bumper rod 72 will contact the vertical face of a gage block 130 on said preceding vehicle. When this occurs, the bumper rod 72 will move inwardly to position the parts in the dashed iine position shown in FIG. 2 whereby the drive wheel 20 is positioned in the vehicle accumulation position, i.e., the drive wheel 20 makes a rolling angle of approximately 2° with drive shaft 18 to thereby maintain a small forward movement of the vehicle 10 and maintain it in contact with the preceding vehicle without any "hunting" or oscillating in this position.

In the event that the vehicle 10 is driven in the rearward direction, as by the drive wheel 20 being in contact with a drive shaft rotated in the opposite direction to that shown in FIG. 1, the vehicle 10 travels along the tracks until it contacts a preceding vehicle thereon, in which case the bumper rod 74 will come in contact with the forward end of said vehicle at the vertical face of a gage block 132 thereon. When this occurs, the bumper rod 74 will move inwardly to move the parts from the solid line position to the dashed line position shown in FIG. 2 and thereby position the vehicle in the vehicle accumulation position maintaining it in contact with the preceding vehicle as described above.

A vehicle 10 moving along tracks 12 and 14 may also be stopped by an outside stopping device which comes into contact with either of the follower rollers 150 and 151. In this case, typically, the drive wheel 20 willbbe actuated to the position wherein there is a 0° rolling angle and the drive shaft will not impart any driving force to the vehicle 10.

It will be apparent that various changes may be made in the construction and arrangement of parts without departing from the scope of the invention, which is defined by the following claims. For example, the vehicle 10 may be provided with one or more of the drive wheel means as discussed above, the use of multiple drive wheel means facilitating the added advantage of spaning gaps on the drive shaft means at interfacing connections.

What is claimed is:

1. A vehicle for use in a vehicle and track system having an elongated track and rotating drive shaft extending along and parallel to the track, comprising:

a vehicle body having a top side, a bottom side and a lateral side, support wheel means on the bottom side of said vehicle body constructed and arranged to ride on said track and support said vehicle thereon, drive wheel means including a drive wheel mounted on said vehicle body to extend from said lateral side of said vehicle body into driving contact with a rotating drive shaft adjacent said lateral side, means mounting said drive wheel for movement about a horizontal axis between a drive position in which said vehicle is driven along said track at a high speed and a vehicle accumulation position in which said vehicle is maintained in a stopped position in contact with another vehicle means on said track, and vehicle speed control means including means for actuating said drive wheel between said two position thereof.

2. A vehicle according to claim 1 wherein said drive wheel actuating means comprises a first control member projecting forwardly from the front end of said vehicle body when said drive wheel is in said drive position, a second control member projecting rearwardly from the rear end of said vehicle body when said drive wheel is in said drive position, means mounting both said control members for unhindered inward movement as the vehicle is driven in either direction on said track, and means operatively connected to said first and second control members and to said drive wheel and movable in response to the inward movement of either of said control members for moving said drive wheel between said drive position and said vehicle accumulation position.

3. A vehicle according to claim 2 wherein said first control member comprises a bumper rod mounted for sliding movement on said vehicle body and having a free end projecting from the front end of said vehicle in said drive position, said second control member comprises a bumper rod mounted for sliding movement on said vehicle body and having a free end projecting from the rear end of said vehicle of said drive position, and said actuating means comprises a linkage means pivoted in the center thereof and engaged at extended portions thereof with said first and second control members inwardly of said free ends thereof for causing conjoint movement of both of said first and second control members.

4. A vehicle according to claim 2 wherein said speed control means includes means adapted to be contacted by an obstruction located along the track to move said drive wheel from said drive position.

5. A vehicle according to claim 4 wherein said last-named means comprises a pair of follower rollers, one of said follower rollers being mounted on said first control member for movement therewith and the other of said follower rollers being mounted on said second control member for movement therewith.

6. A vehicle according to claim 1 including spring means for biasing said drive wheel into driving contact with said drive shaft.

7. A vehicle according to claim 1 wherein said drive wheel, said drive wheel mounting means and said vehicle speed control means are constructed and arranged to position the drive wheel in an angular position to set a substantial rolling angle between said drive wheel and said drive shaft in said drive position for causing said vehicle to move in a forward direction, and are constructed and arranged to set a small rolling angle between said drive wheel and said drive shaft in said vehicle accumulation position to maintain a small driving force between said drive wheel and said drive shaft in the forward direction.

8. A vehicle according to claim 1 wherein the track system comprises a pair of spaced apart parallel tracks, and said support wheel means comprises four pairs of cooperating wheels including four support wheels mounted to ride on the upper surfaces of said pair of tracks to support the vehicle thereon and four retaining wheels mounted to ride on the underside; of the tracks for restraining the vehicle thereon.

9. A vehicle according to claim 8 wherein said tracks have a circular cross-section and each pair of cooperating wheels are arranged so that the retaining wheel rides on the tracks at a location on the circumference thereof below the horizontal plane extending through the longitudinal axis thereof, whereby each pair of cooperating wheels contact the surface of a track at locations spaced apart around the track circumference a distance slightly greater than one-fourth of the track circumference.

10. 14. A vehicle according to claim 8 wherein said support wheel means is constructed and arranged so that the vehicle is self supporting on the track means independently of said drive shaft and such that the driving contact of said drive wheel on said drive shaft is not affected by the load carried by the vehicle.

11. The vehicle according to claim 1 including means for maintaining a precise distance between accumulated vehicles including a pair of precision gage blocks, one of said blocks being mounted on the front end of said vehicle body to provide a precise front end vehicle contacting surface and the other being mounted on the rear end of the vehicle body to provide a precise rear end vehicle contacting surface.

12. A vehicle for use in a vehicle and track system having an elongated track and rotating drive shaft extending along and parallel to the track, comprising:

a vehicle body, support wheel means on the bottom side of said vehicle body constructed and arranged to ride on said track and support said vehicle thereon, drive wheel means including a drive wheel mounted on the side of said vehicle body and extending therefrom into driving contact with said rotating drive shaft, means mounting said drive wheel for movement about a horizontal axis between a drive position in which said vehicle is driven along said track at a high speed and a vehicle accumulation position in which said vehicle is maintained in a stopped position in contact with another vehicle means on said track, and vehicle speed control means including means for actuating said drive wheel between said two positions thereof, said drive wheel actuating means comprising a first control member projecting forwardly from the front end of said vehicle body when said drive wheel is in said drive position, a second control member projecting rearwardly from the rear end of said vehicle body when said drive wheel is in said position, and means operatively connected to said first and second control members and to said drive wheel and movable in response to the inward movement of either of said control members for moving said drive wheel between said drive position and said vehicle accumulation position, said means mounting said drive wheel including a pivot shaft mounted for rotation about a horizontally extending axis, and said means operatively connected to said first and second control members and to said drive wheel including a control arm connected to said pivot shaft and to one of said control members.

13. A vehicle according to claim 12 wherein said drive wheel actuating means includes means for biasing said control members to said drive position, said biasing means including a first stop member secured to one of said control members for movement therewith, a second stop member secured to said vehicle body, and spring means arranged to urge said first stop member toward a position in which said first and second stop members are in contact.

14. A vehicle for use in a vehicle and track system having an elongated track and a rotating drive shaft extending along and parallel to the track, comprising:

a vehicle body, support wheel means on the bottom side of said vehicle body constructed and arranged to ride on said track and support said vehicle thereon, drive wheel means including a drive wheel mounted on the side of said vehicle body and extending therefrom into driving contact with said rotating drive shaft, means mounting said drive wheel for movement about a horizontal axis between a drive position in which said vehicle is driven along said track at a high speed and a vehicle accumulation position in which said vehicle is maintained in a stopped position in contact with anther vehicle means on said track, and vehicle speed control means including means for actuating said drive wheel between said two positions the track system comprising a pair of spaced apart parallel tracks, said support wheel means comprising four pairs of cooperating wheels including four support wheels mounted to ride on the upper surfaces of said pair of tracks to support the vehicle thereon and four retaining wheels mounted to ride on the underside of the tracks for restraining the vehicle thereon, each pair of said cooperating pairs of wheels being carried on a block mounted on the underside of the vehicle body, two of said blocks being fixedly secured to the underside of the body adjacent one of said pair of tracks and the other two of said blocks being mounted for sliding movement laterally of the vehicle body toward and away from the other of said tracks whereby the vehicle is removable from said tracks.

15. The vehicle body according to claim 14 including spring means associated with each of said movable blocks for biasing the same laterally outwardly toward the track associated therewith.

* * * * *